United States Patent [19]

de la Haye

[11] Patent Number: 4,615,277

[45] Date of Patent: Oct. 7, 1986

[54] STACKING ELEMENT AND A GALLERY, PLATFORM OR THE LIKE, PROVIDED WITH SUCH A STACKING ELEMENT

[76] Inventor: Cornelis F. de la Haye, Starrenboschstraat 11, 1097 MB Amsterdam, Netherlands

[21] Appl. No.: 564,592

[22] Filed: Dec. 22, 1983

[30] Foreign Application Priority Data

Dec. 29, 1982 [NL] Netherlands ..... 8205033

[51] Int. Cl.[4] ..... E04C 1/30

[52] U.S. Cl. ..... 108/101; 52/581; 52/637; 108/55.1; 108/91; 108/111; 108/157; 182/113; 206/513; 211/181; 211/194; 297/232

[58] Field of Search ..... 108/92, 93, 96, 97, 108/98, 91, 101, 157, 111, 53.1, 55.1, 53.5; 211/189, 181, 194, 188, 184, 133; 182/152, 113; 297/232, 239; 135/109, 111; 206/513; 220/6, 7, 19; 256/24, 73; 52/658, 581, 637, 690, 36

[56] References Cited

U.S. PATENT DOCUMENTS

| | | | |
|---|---|---|---|
| 1,555,022 | 9/1925 | Proctor | 108/55.1 X |
| 2,239,483 | 4/1941 | Cocks | 211/181 X |
| 2,611,422 | 9/1952 | Roney | 211/189 X |
| 2,660,328 | 11/1953 | Averill | 108/55.1 X |
| 2,985,332 | 5/1961 | Fredrick | 206/513 X |
| 2,997,812 | 8/1961 | Veillet | 52/690 X |
| 3,139,987 | 7/1964 | Rubio et al. | |
| 3,270,997 | 9/1966 | Gethmann | 182/113 X |
| 3,314,549 | 4/1967 | Goldreich et al. | 211/181 X |
| 3,318,461 | 5/1967 | Marschak | 211/133 |
| 3,394,963 | 7/1968 | Antonioli | |
| 3,489,385 | 1/1970 | Dill, Jr. | 211/181 X |
| 3,680,712 | 8/1972 | Jurasek | 211/181 |
| 3,704,791 | 12/1972 | Young, Jr. | 211/181 X |
| 4,106,626 | 8/1978 | Trubiano | 206/513 |
| 4,361,991 | 12/1982 | Wiese | |
| 4,391,378 | 7/1983 | Secon | 108/91 X |
| 4,498,595 | 2/1985 | Wilson | 211/181 X |
| 4,508,300 | 4/1985 | Minick | 52/36 X |

FOREIGN PATENT DOCUMENTS

| | | | |
|---|---|---|---|
| 637235 | 12/1965 | Belgium | 211/188 |
| 725970 | 1/1966 | Canada | 297/232 |
| 945346 | 7/1956 | Fed. Rep. of Germany | |
| 1052278 | 3/1952 | France | |
| 1468235 | 2/1966 | France | |
| 7111962 | 4/1971 | France | |
| 2379444 | 10/1978 | France | 206/513 |
| 601037 | 12/1959 | Italy | 211/133 |
| 378006 | 7/1964 | Switzerland | 211/133 |
| 1557178 | 12/1979 | United Kingdom | 211/181 |

*Primary Examiner*—William E. Lyddane
*Assistant Examiner*—Thomas A. Rendos
*Attorney, Agent, or Firm*—Biebel, French & Nauman

[57] ABSTRACT

A stacking element comprising interconnectable panels, each consisting of at least two wires or bars bent in the plane of the panel, said wires or bars being interconnected with interposition of at least one wire or bar bent in the shape of a U, substantially projecting at the bottom from the two wires or bars bent in the plane of the panel. On the upper elements there may be provided set and/or floor portions which may be fitted at the top with recesses or the like for mounting chairs thereon.

4 Claims, 6 Drawing Figures

FIG. 2
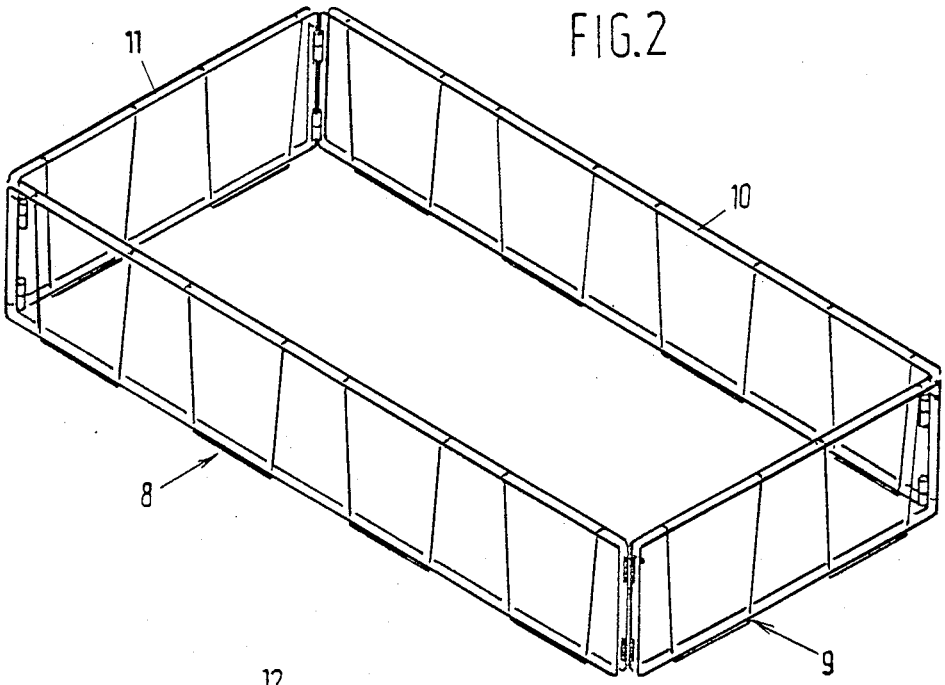
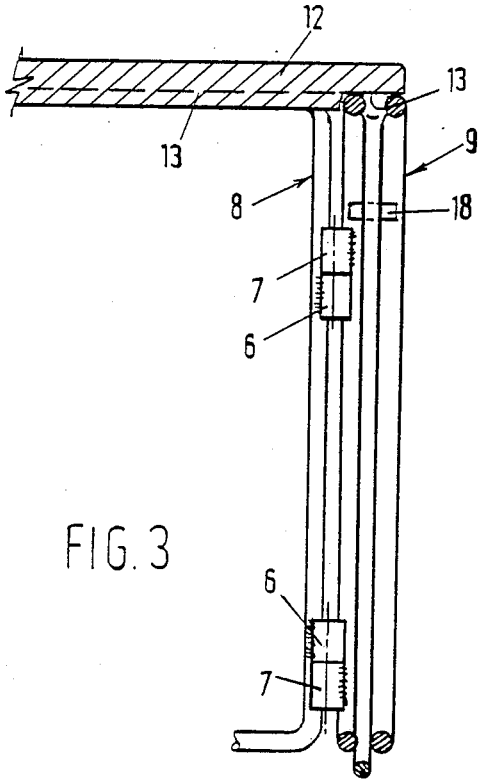
FIG. 3
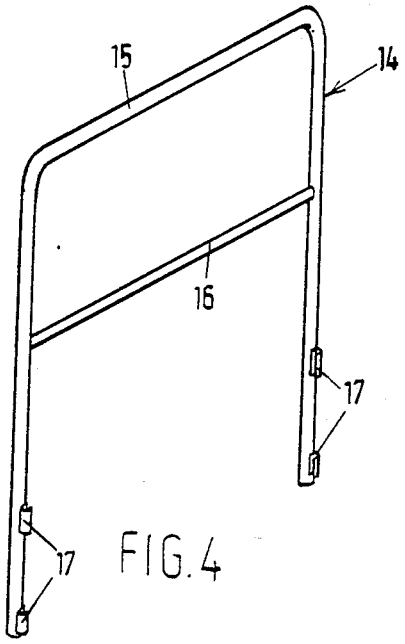
FIG. 4

STACKING ELEMENT AND A GALLERY, PLATFORM OR THE LIKE, PROVIDED WITH SUCH A STACKING ELEMENT

BACKGROUND OF THE INVENTION

The invention relates to a stacking element comprising interconnectable panels.

Such stacking elements, mostly consisting of tubes and/or bars and boards, are usually heavy and hence difficult to transport. Also the interconnection of the panels and the stacking elements often entails problems.

SUMMARY OF THE INVENTION

It is an object of the invention to provide a stacking element of such a construction that a plurality of elements can be readily stacked and interlocked, and which moreover is light and inexpensive.

To this effect, the stacking element is characterized in that each panel comprises at least two interconnected wires or bars sent in the plane of the panel.

The bars or wires may be interconnected with interposition of at least one wire or bar, bent substantially in the shape of a U. Naturally, the wire may also be bent into a V-shape or the like.

For the interlocking in the stacked condition, the U-shaped wires or bars may project at the bottom from the two wires or bars bent in the plane of the panel. It is observed in this respect that the legs of the U-shaped wire or bar slightly diverge in a known manner.

In order to facilitate the stacking and destacking, it is proposed to make the distance between the two bars or wires bent in the plane of the panel larger at the top than at the bottom. This can be achieved by providing the U-shaped wire or bar received between the bent wires or bars, at the free ends of the legs, with a flattening transverse to the plane of the U-shaped wire, thereby producing a broadening.

To obtain a proper interlocking in mounted condition of stacked elements, the body of each U-shaped wire or bar may be provided with one or more kinks, so that there is produced a snapping action during assembly.

The invention further relates to a gallery, platform or the like comprising interconnected and/or stacked stacking elements, as described in the above, and with seat and/or floor portions being mounted on the upper elements. The gallery according to the invention is characterized by hand or guard rails, the lower ends of which are fitted with such attachment or gripping elements that the rail can be mounted, for example by sliding movement, on the vertical portion of the said wires or bars bent in the plane of the panel, of the subjacent stacking element(s).

In order to fix the seat and/or floor portions relative to the subjacent stacking element, these portions may be provided at the bottom with recesses or lugs adapted for coaction with the top edge of the subjacent stacking element.

Besides, when the gallery is fitted exclusively with floor portions, said floor portions may be provided at the top with recesses or the like for mounting chairs thereon.

BRIEF DESCRIPTION OF THE DRAWINGS

One embodiment of a stacking element, as well as of a gallery composed of such stacking elements, will now be described, by way of example, with reference to the accompanying drawings, in which:

FIG. 2 is a perspective view of a stacking element composed of panels similar to those shown in FIG. 1;

FIG. 3 shows an enlarged detail of a corner portion of the stacking element shown in FIG. 2 fitted with a floor portion;

FIG. 4 shows a hand or guard rail adapted for coaction with a panel;

DESCRIPTION OF PREFERRED EMBODIMENTS

Figure 1:
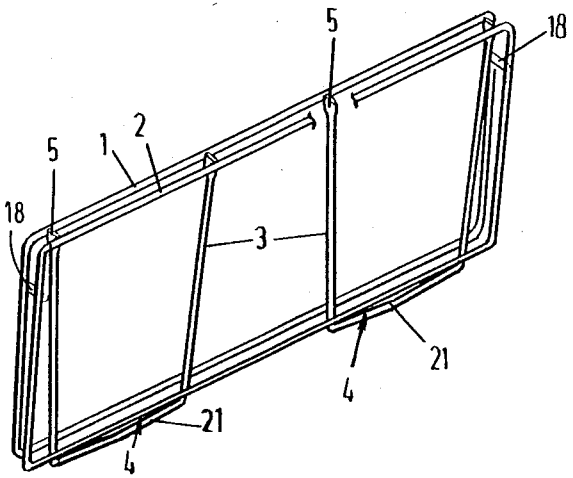
FIG. 1 is a perspective view of a panel with a portion thereof broken away.

As shown in FIG. 1, a panel comprises two closed wires 1 and 2 bent in the plane of the panel and having round cross-sections.

The wires 1 and 2 are interconnected by a plurality of substantially U-shaped wires 3 (in the present case two). As shown in the drawings, the wires 1 and 2 are spaced a greater distance apart at the top than at the bottom. Moreover, the free ends of the legs of each U-shaped wire are somewhat more widely apart than the ends connected to the body of the U-shaped wire. Furthermore, by having the U-shaped wire project at the bottom from the circumference of the closed wires, said projecting end 4 can be used for stacking by the connection to a underlying panel.

As in particular shown in FIGS. 1 and 3, the distance between the top and bottom of the two closed wires 1 and 2 is different. This difference is obtained by providing the U-shaped wires 3, at the free ends of the legs, transverse to the plane of the wire, for attachment between the wires 1 and 2, with broadenings or flattenings 5.

In order to obtain a proper locking in stacked condition of the panels, the body of one or each U-shaped wire is fitted with a kink 21.

As further shown in the drawings, the vertical end edges of one of the two interconnected bent wires 1, 2 are each provided with two hinge loops 6,6 and 7,7. The hinge loops 6 are arranged closer together than the loops 7, enabling successive stacking elements to be interconnected by means of a pivot pin, not shown.

As observed before, FIG. 2 shows four interconnected panels 8, 9, 10 and 11, each pair being of equal length.

FIG. 3 shows the interconnected panels 8, 9 and a floor plate 12 mounted thereon. The floor plate 12 comprises recesses 13 for engagement by the top ends of the panels 8, 9, 10 and 11 therein, thus locking the floor plate relative to the stacking element.

Figure 5:
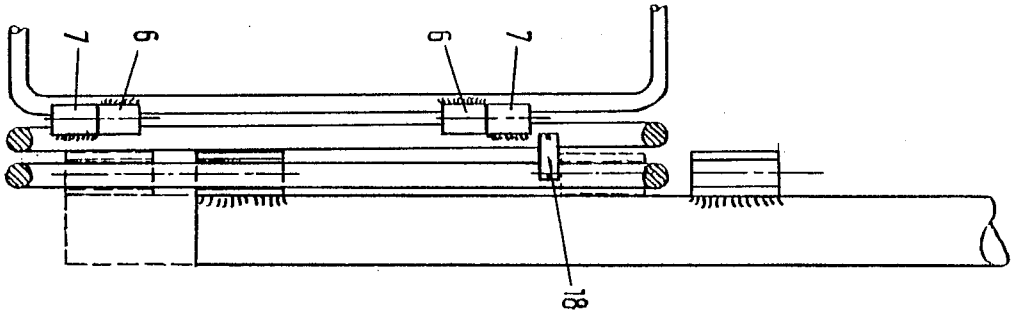
FIG. 5 shows a rail according to FIG. 4 during assembly on a panel.

FIG. 4 shows a hand or guard rail 14 comprising an inverted U-shaped tube 15 whose legs are interconnected for the purpose of reinforcement by a rod 16 extending parallel to the body. As further shown in FIG. 4, the rail is provided at the free ends of the legs, with two spaced apart, superimposed hooks 17, which, as shown more in particular in FIG. 5, are dimensioned so as to allow coaction with the outer one of one of the two closed wires 1 or 2 of a stacking element.

Although not earlier observed hereinbefore but shown in the figures described, the panels of each stacking element may be interconnected by short strips 18 at the corners for the purpose of reinforcement. Said strips can be provided in such a manner that for attaching the hand or guard rail, first the lower one of said hooks 17 has to be pushed from the bottom onto the respective edge of the panel and subsequently, by lowering the hand or guard rail, the upper hooks onto the respective panel edge. As appears from the end position of the hand rail indicated by dashed lines in FIG. 5, the respective strip 18 may then serve as a stop for the hand rail.

Figure 6:
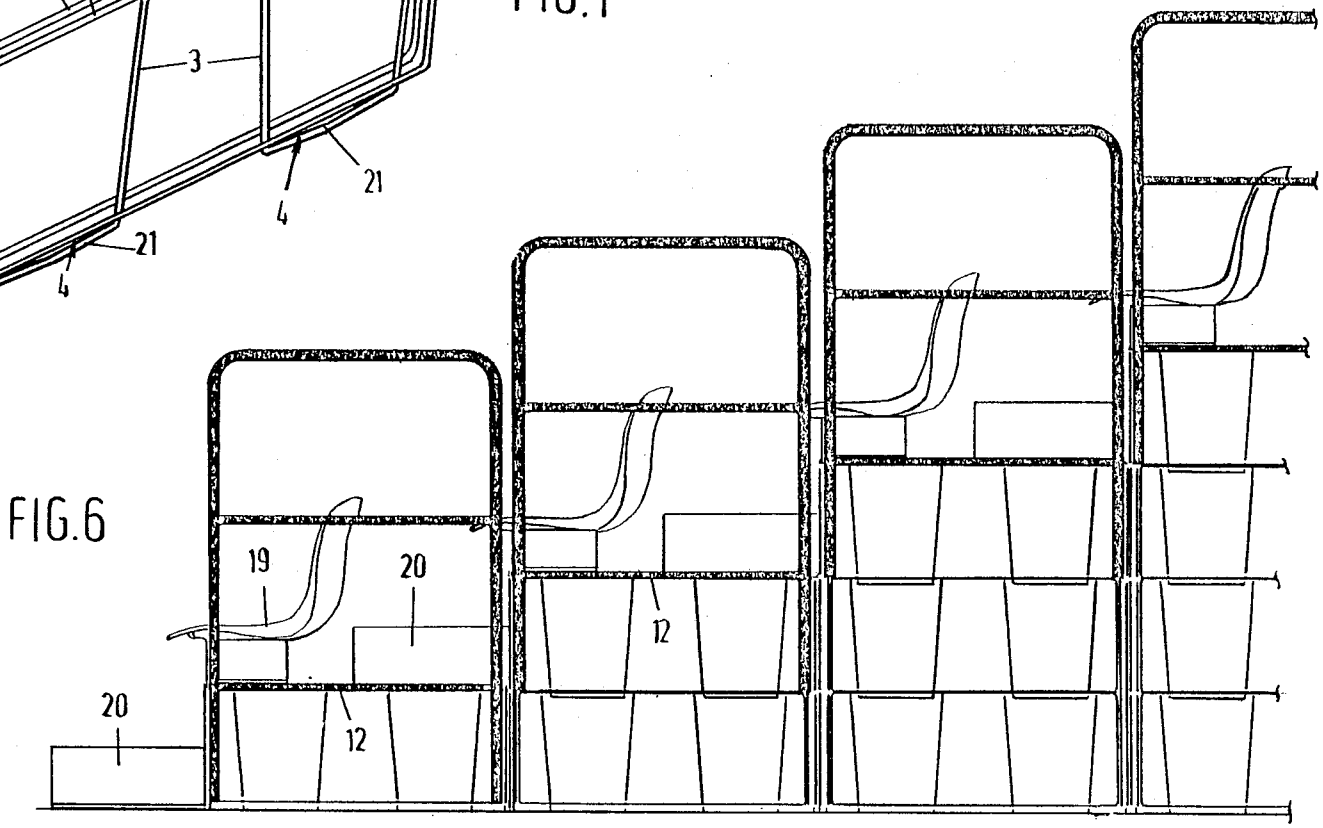
FIG. 6 is a side view of a gallery composed of stacking elements according to the invention.

As appears from the side view of a gallery shown in FIG. 6, a chair 19 can be mounted on each floor plate 12. To this end the chair may be provided at the bottom with elements, not shown, for attachment in recesses, not shown, in the floor portions.

As appears from the above side view of the gallery, a step 20 may be provided on each floor portion adjacent the entrance or "stairway".

In view of the above it will be clear that a large number of variations are possible within the scope of the invention.

What I claim is:

1. A stacking panel for forming gallery seating (or the like) in combination with a plurality of other such panels for supporting platforms in spaced relation to a flooring, comprising a pair of closed rod-like members each being of substantially the same size as the other and each having generally horizontally disposed top and bottom portions joining with left and right upstanding ends, said members positioned in side-by-side spaced apart relation, each said panel further having at least one substantially U-shaped rod-like element having legs positioned in the space between said members and in the plane of said panel, the tops of the legs of said element positioned between said top portions and defining the spacing between said top portions, said element having a connecting bottom extending between said legs and received between said bottom portions of said members and defining the spacing between said panel bottom portions, said connecting bottom extending below said panel bottom portions so as to be received between the spaced top portions of another one of said panels when one said panel is stacked on top of another such panel.

2. The stacking panel of claim 1 including a pair of said U-shaped elements positioned in transversely spaced relation to each other between said rod-like members.

3. The stacking panel of claim 1 in which the said legs of said U-shaped element, at their tops, are flattened transverse to the plane of said panel between the top portions thereof to define a transverse space which exceeds the transverse space between said bottom portions to facilitate reception of a connecting bottom of another said panel stacked thereon.

4. The stacking panel of claim 1 further comprising a plurality of generally upstanding U-shaped hand rails having spaced apart legs which are spaced substantially corresponding to the spacing of said upstanding ends and means on said legs for engaging said panel at said ends thereof and supporting said hand rail with a portion extending above the associated said panel.

* * * * *

UNITED STATES PATENT AND TRADEMARK OFFICE

CERTIFICATE OF CORRECTION

PATENT NO. : 4,615,277

DATED : October 7, 1986

INVENTOR(S) : Cornelis F. de la Haye

It is certified that error appears in the above-identified patent and that said Letters Patent is hereby corrected as shown below:

On the Title Page:

Item [76] Inventor: delete the address shown and insert

-- Gevers Deynootweg 590
2686 BS 's-Gravenhage
The Netherlands --.

Signed and Sealed this

Twenty-second Day of September, 1987

*Attest:*

DONALD J. QUIGG

*Attesting Officer* *Commissioner of Patents and Trademarks*